US009500322B2

(12) United States Patent
Watson et al.

(10) Patent No.: US 9,500,322 B2
(45) Date of Patent: Nov. 22, 2016

(54) WEATHER SEALED LIGHTING SYSTEM WITH LIGHT-EMITTING DIODES

(75) Inventors: Michael L. Watson, Roselle, IL (US); Steven R. Walczak, Kenosha, WI (US)

(73) Assignee: Sternberg Lanterns, Inc., Roselle, IL (US)

( * ) Notice: Subject to any disclaimer, the term of this patent is extended or adjusted under 35 U.S.C. 154(b) by 1331 days.

(21) Appl. No.: 13/024,690

(22) Filed: Feb. 10, 2011

(65) Prior Publication Data

US 2012/0206910 A1 Aug. 16, 2012

(51) Int. Cl.

| | |
|---|---|
| ***F21V 7/20*** | (2006.01) |
| ***F21K 99/00*** | (2016.01) |
| ***F21V 31/00*** | (2006.01) |
| ***F21V 29/74*** | (2015.01) |
| ***F21V 29/77*** | (2015.01) |
| *F21S 8/08* | (2006.01) |
| *F21W 131/10* | (2006.01) |

(52) U.S. Cl.

CPC ..... *F21K 9/30* (2013.01); *F21V 29/74* (2015.01); *F21V 29/77* (2015.01); *F21V 31/005* (2013.01); *F21S 8/08* (2013.01); *F21W 2131/10* (2013.01)

(58) Field of Classification Search

CPC ..... F21K 99/00; F21K 9/30; F21V 29/00; F21V 31/00; F21V 31/005; F21V 29/77; F21V 29/74; H01L 33/00; F21W 2131/10; F21S 8/08

USPC ..... 362/33, 84, 157, 178, 185, 202, 217.01, 362/218, 222, 217.1, 217.12, 217.13, 88, 362/171, 164, 158, 249.02, 294, 296.05, 362/311.06, 373, 374, 375

See application file for complete search history.

(56) References Cited

U.S. PATENT DOCUMENTS

| | | | | |
|---|---|---|---|---|
| 7,513,653 | B1 * | 4/2009 | Liu | F21V 29/004 362/218 |
| 7,547,126 | B2 | 6/2009 | Hiratsuka | |
| 7,581,856 | B2 | 9/2009 | Kang et al. | |
| 7,631,988 | B2 | 12/2009 | Xie et al. | |
| 7,661,854 | B1 * | 2/2010 | Yang | F21K 9/00 362/249.02 |
| 7,731,383 | B2 | 6/2010 | Myer | |
| 7,758,214 | B2 | 7/2010 | Lee et al. | |
| 7,837,358 | B2 | 11/2010 | Liao | |
| 8,104,929 | B2 | 1/2012 | Kovalchick et al. | |
| 2002/0191396 | A1 | 12/2002 | Reiff et al. | |
| 2009/0046464 | A1 | 2/2009 | Liu et al. | |
| 2009/0244896 | A1 | 10/2009 | McGehee et al. | |
| 2009/0257226 | A1 * | 10/2009 | Liu et al. | 362/249.02 |
| 2009/0267519 | A1 | 10/2009 | Pearse | |
| 2009/0268453 | A1 | 10/2009 | Pearse | |

(Continued)

OTHER PUBLICATIONS

Canadian Office Action dated Aug. 20, 2012, CA App. No. 2,731,609 of Applicants' corresponding Canadian application.

*Primary Examiner* — Jason Moon Han
*Assistant Examiner* — Omar Rojas Cadima
(74) *Attorney, Agent, or Firm* — Seyfarth Shaw LLP

(57) ABSTRACT

An outdoor lighting system utilizing light-emitting diodes (LEDs) and structures to dissipate heat generated by the LEDs. The system includes a tubular enclosure housing an internal LED lighting assembly including LEDs mounted to a finned support structure which extends between two ends of the tube. At the end of the tube is at least one heat dissipating structure which is retained on the tubular enclosure by the threaded fastener. A heat dissipating structure in the form of a finned heat sink having an integrated, formed-in-place gasket abutting the end of the tubular enclosure.

9 Claims, 3 Drawing Sheets

(56) References Cited

U.S. PATENT DOCUMENTS

| | | | | |
|---|---|---|---|---|
| 2009/0284972 | A1 | 11/2009 | Chang | |
| 2010/0008085 | A1 | 1/2010 | Ivey et al. | |
| 2010/0033969 | A1 | 2/2010 | Hochstein et al. | |
| 2010/0128475 | A1 | 5/2010 | Kovalchick et al. | |
| 2010/0188850 | A1 | 7/2010 | Maxik et al. | |
| 2010/0208457 | A1 | 8/2010 | Keal | |
| 2010/0214785 | A1* | 8/2010 | Chen | 362/267 |
| 2010/0265710 | A1* | 10/2010 | Xiao et al. | 362/249.02 |

* cited by examiner

WEATHER SEALED LIGHTING SYSTEM WITH LIGHT-EMITTING DIODES

FIELD OF THE INVENTION

The present invention relates generally to a lighting system utilizing light-emitting diodes (LEDs) and, more particularly, to a substantially weather-sealed LED based lighting system with improved heat dissipation.

BACKGROUND

Light emitting diodes (LEDs) have several major benefits compared to other lighting source. For example, LEDs typically have longer life spans than other comparable light emitting elements, such as incandescent lights or fluorescent lights. Moreover, LEDs are typically more energy efficient, compared to conventional light emitting sources. Thus, LEDs are incorporated into many applications where it is costly to operate and/or difficult to replace the light elements. Moreover, relative to size, an LED can produce a greater amount of light, measured in lumens, than a comparatively sized non-LED light. For this reason, LEDs have been incorporated into many applications requiring small-sized light elements.

As an LED provides more light, the obvious corollary of greater light with respect to power consumption is that an LED wastes less power in the form of heat. Nonetheless, a large portion of generated heat is lost not on the light-emitting side of the diode, but instead at its circuitry base. The diode, which is an electrical circuit component, is typically mounted on a printed wiring or printed circuit board, referred to as a PCB. The heat generated by the diode is initially transferred to the PCB, and the PCB often includes a heat dissipation structure. For example, an 8-watt LED that includes proper heat dissipation may have a ten-year life span of daily 8-hour usage, while the same LED without proper heat dissipation may fail in approximately twenty minutes.

With the substantial benefits afforded LEDs, efforts have been made to incorporate LEDs into pole or stanchion-type lights, such as outdoor lamps, street lights or lantern. In line with traditional approaches to construction, LED-based outdoor lights include an internal assembly that is mounted inside of an outer shell in order to protect the internal assembly from the elements of the weather. This internal assembly typically includes a main body formed of cast aluminum for the heat dissipation structure. However, when the internal assembly is mounted within its outer shell, the internal assembly is housed within a cavity of air within the shell, and the air acts as an insulator, thus impeding heat dissipation. Moreover, within a substantially weather-sealed LED, the weather-sealed structure retains heat and it is difficult to transfer heat from inside the weather-sealed structure of the LED lighting system to outside of such structure. The result is that this type of weather-sealed LED lighting system has poor heat dissipation.

As a result, there is a need for an improved light assembly and, in particular, improved heat dissipation for use within substantially weather-sealed LED-based lighting systems.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages, should be readily understood and appreciated.

DETAILED DESCRIPTION

Figure 1:
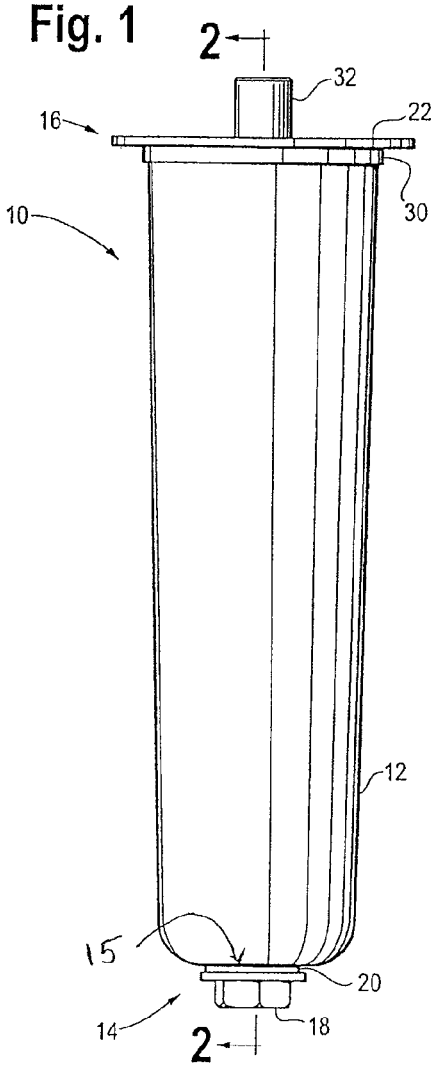
FIG. 1 is an exterior side view of a LED light system incorporating an embodiment of the present invention.

While the present invention is susceptible of embodiments in many different forms, there is shown in the drawings and will herein be described in detail illustrative embodiments of the present invention with the understanding that the disclosure is to be considered as an exemplification of the principles of the invention and is not intended to limit the broad aspect of the invention to embodiments illustrated.

Figure 2:
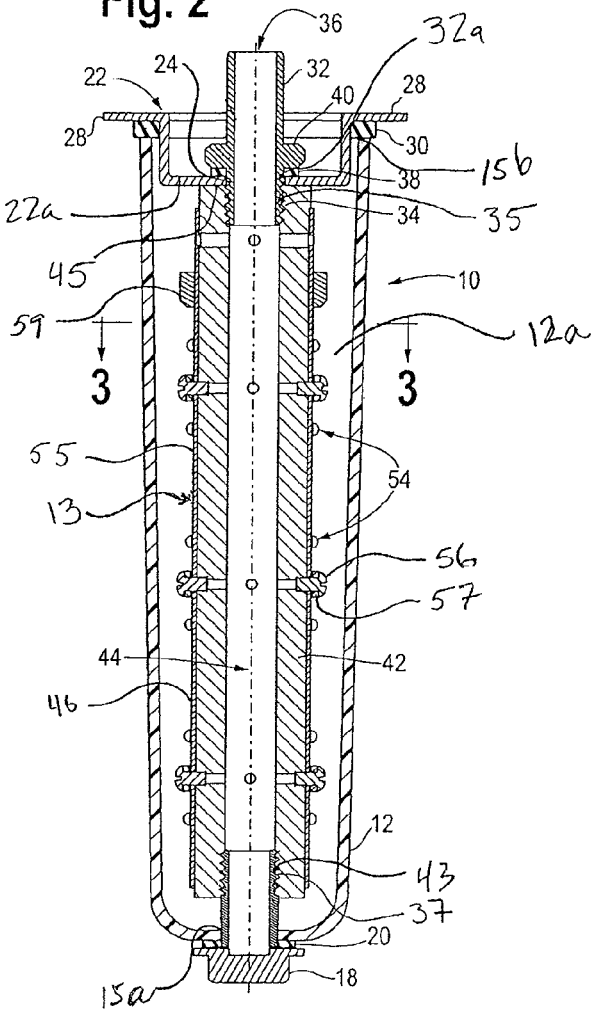
FIG. 2 is cross-sectional side view of the LED light system taken along line 2-2 of FIG. 1.

Referring to FIG. 1, a LED light assembly 10 designed for typical outdoor use is shown. In an embodiment, the LEDs components are housed within a substantially weather-sealed tube 12 having an internal cavity 12*a* (FIG. 2). The tube 12 can be constructed of any type of weather-resistant material, such as, for example, acrylic, and is preferably transparent to allow easy light penetration. Referring also to FIG. 2, in an embodiment, the tube 12 includes first end 14 and second end 16, each end 14, 16 includes respective openings 15*a*, 15*b* allowing access to the internal cavity 12*a* of the tube 12. In an embodiment, the opening 15*a* in first end 14 is small than the diameter of the cavity 12*a*. In an embodiment, the diameter of the opening 15*b* in second end 16 is substantially the same as the diameter of the cavity 12*a*.

At first end 14, a fastener 18, in the form of an ordinary bolt, for example, penetrates aperture 15*b* and is adapted to threadably engage internal threads 43 of support structure 42. In an embodiment, the fastener 18 and tube 12 interface is substantially weather-sealed, such as with a gasket 20 constructed of an elastomeric material, such as, for example, silicone. The fastener 18 is preferably constructed of a thermally conductive material, such as, for example, a metal, to provide and enhance external thermal transfer of the heat extracted by the heat dissipation structure enclosed within the tube 12, as discussed below.

At second end 16, a heat-dissipating spun cap 22 is coupled to the open end of tube 12. In an embodiment, cap 22 is retained by a threaded fastener 32. In an embodiment, threaded fastener 32 is adapted to be coupled to a mounting structure (not shown), such as, for example, a post or pole. The cap 22 is preferably constructed of a thermally conductive material such that the cap 22 is capable of transferring heat from the cavity 12*a* (FIG. 2) of the lighting assembly 10 to the mounting structure and outside environment. In an embodiment, the cap 22 is generally U-shaped in cross-section and includes a peripheral flange 28 that is adapted to circumferentially extend beyond the outer edge of the aperture 15*b* of first end 14. To provide a substantially weather-tight seal between the cap 22 and tube 12, a gasket 30 may be circumferentially disposed in the opening of the tube 12 intermediate the tube 12 and the flange 28. In an embodiment, the gasket 30 may be constructed of an elastomeric material, such as silicone or other water-sealing material. In an embodiment, the abutment between the cap 22 and tube 12 with gasket 30 substantially protects the internal component 13 of the LED light assembly 10 to an International Protection Rating (also known as an Ingress Protection Rating) of 65 ("IP65") to ensure the proper protection from the ingress of external solids and liquids.

As mentioned, a fastener 32 threadably retains cap 22 on the tube 12. The fastener 32 includes a downwardly extending protrusion 32*a* which is adapted to axially penetrate a centrally disposed aperture 24 located in base 22*a* of cap 22. In an embodiment, the threaded fastener 32 includes an axial channel 36 that is adapted to permit pass-through of wiring for the internal component 13 disposed within the tube 12. In an embodiment, a substantially weather-tight gasket 38, such as a gasket constructed of an elastomeric material, such as silicone, is disposed between a circumferential lip 40 of fastener 32 and the cap 22. Downwardly extending protrusion 32*a* of fastener 32 includes threads 35 adapted to penetrate and engage internal threads disposed in channel 44 of support structure 42. Fastener 32 maintains engagement between support structure 42 and base 22*a* of cap 22 to thermally couple internal component 13 to external environment via cap 22. As such, configuration of support structure 42 within cavity 12*a* of tube 12 is maintained by fasteners 32 and 18.

Disposed within the cavity 12*a* of tube 12 is the internal component 13 which includes a LED and a support structure 42 axially extending between ends 14 and 16 of the tube 12 and adapted to support LEDs 54. In an embodiment, the LEDs 54 are mounted on a printed wiring or printed circuit board 55 and the circuit boards 55 are secured to the exterior of support structure 42 by a screw 56 and washer 57. Washer 57 may be constructed of silicone or other suitable material to provide over-torque protection to the assembly and prevent damage to the circuit board 55 by screw 56. The support structure 42 is preferably constructed of material capable of effectively dissipating heat, such as, for example, aluminum. The support structure 42 is preferably hollow, having an axial cylindrical channel 44 extending the length of the support structure 42. The channel 44 includes receiving threads 34 on the inner surface thereof for threadable engagement with the threads 35 and 43 of fasteners 32 and 18, respectively.

At end 16 adjacent the spun cap 22, a connector 59, such as, for example, a Tyco Surface Mount Technology connector or equivalent, is mounted to the external surface of support structure 42. Connector 59 accepts the wiring passing through axial channel 36 of fastener 32, connecting the wiring to the printed circuit boards 55. A plurality of connectors 59 may be mounted on sides of the support structure 42.

Figure 3:
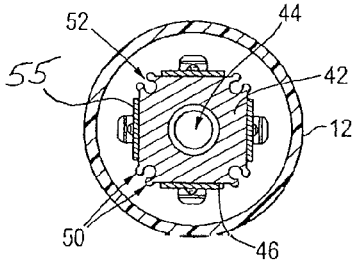
FIG. 3 is a cross-sectional view of the LED light system taken along line 3-3 of FIG. 2.

Referring also to FIG. 3, the support structure 42 includes generally planar exterior walls 46, and an internally cylindrical channel 44. In cross-section, the support structure 42 may be generally rectangular, triangular, or other suitable shape. On the exterior walls 46 of the support structure 42 are mounted one or more LEDs 54. In an embodiment, at the intersecting corners of the exterior walls 46 are laterally extending protrusions 50 offset by a corresponding groove 52. The fins 50 and groove 52 increase the surface area of the support structure 42, thereby increasing heat dissipating capacity to the internal component 13. Though depicted with two fins 50 and a single groove 52, it will be appreciated that the present invention may include a plurality of grooves 52 and corresponding fins 50 to increase the surface area of the support structure 42.

In an embodiment, when assembled, a first end 45 of the support structure 42 abuts the cap 22 to increase heat dissipation. The heat extracted from the LEDs by the support structure 42 is transferred to the cap 22 via thermal conduction. The cap 22 may then transfer the heat to a mounting structure (not shown) of the LED light assembly 10, or dissipate the heat via air.

Figure 5:
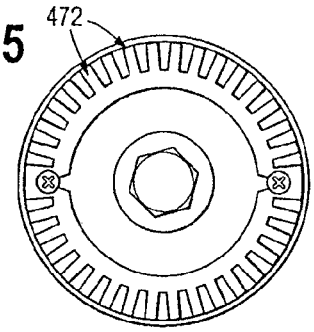
FIG. 5 is an external top plan view of the LED light system of FIG. 4.
Figure 4:
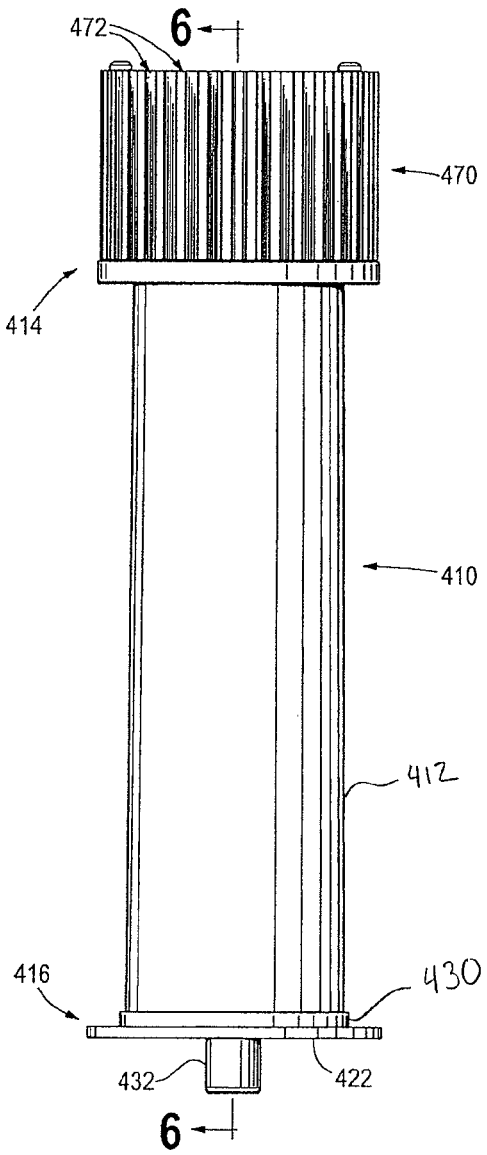
FIG. 4 is an external side view of a LED light system incorporating another embodiment of the present invention.
Figure 6:
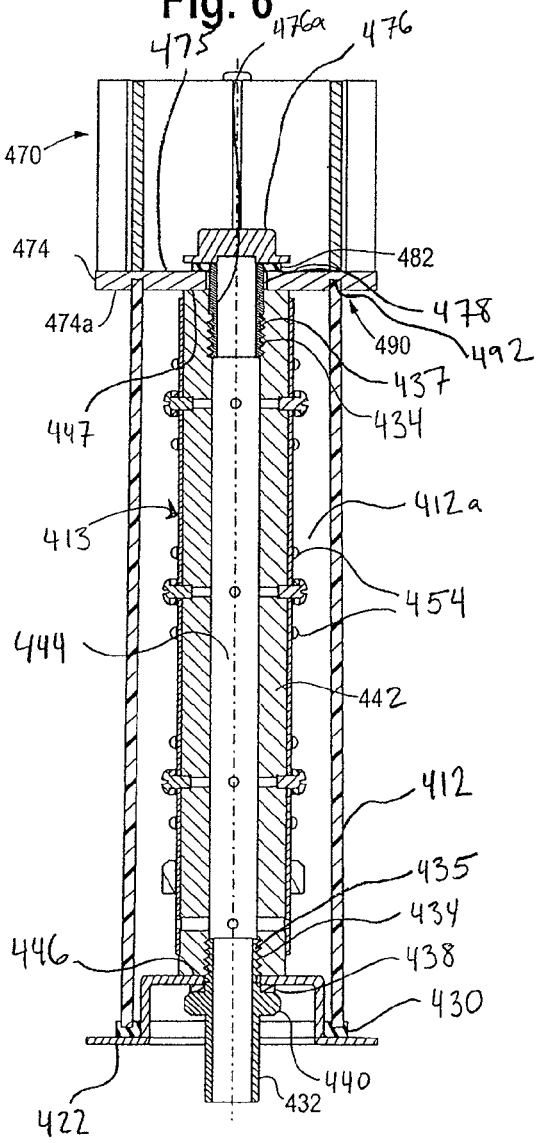
FIG. 6 is vertical cross-sectional side view of the LED light system depicted in FIG. 4.
Figure 7:
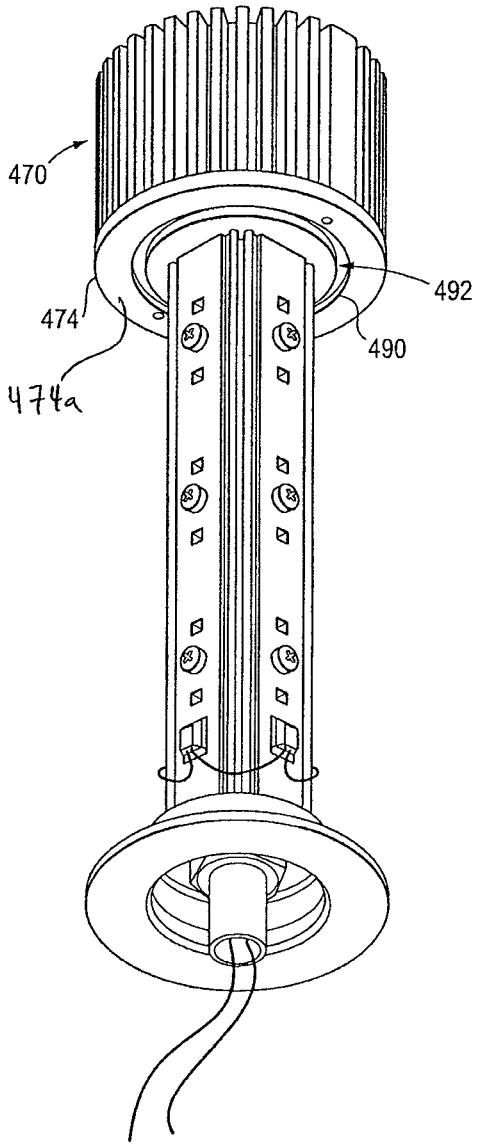
FIG. 7 is a perspective view of the internal components of the LED light system removed from the tube depicted in FIG. 4.

Referring now to FIGS. 4-6, in another embodiment, the internal component 413 is adapted to retain one or more LEDs and may include two heat-dissipating structures disposed at either first end 414 and/or second end 416 of tube 412, which retains the internally disposed internal component 413 therebetween. The heat generated by the internal LEDs 454 coupled to the LED assembly 413 is vertically extracted by support structure 442 and externally dissipated at ends 414 and 416 of the assembly 410, thereby increasing the performance and longevity of the LEDs 454.

As shown in FIGS. 4-6, the tube 412 is generally cylindrical. As in the embodiment depicted in FIG. 1-FIG. 3, disposed within the cavity 412*a* of tube 412 is internal component 413 which includes a support structure 442 axially extending between ends 414 and 416 of the tube 412 and adapted to support the LED light elements 454. The support structure 442 is preferably constructed of material capable of effectively conducting heat, such as, for example, aluminum. The support structure 442 is preferably hollow, having an axial cylindrical channel 444 extending the length of the support structure 442. The channel 444 includes receiving threads 434 on the inner surface thereof for threadable engagement with the threads 435 and 437 of fasteners 432 and 476, respectively.

At second end 416, a heat-dissipating spun cap 422 is coupled on the open end of the tube in the same manner as spun cap 22 in the prior embodiment depicted in FIG. 1-FIG. 3. In an embodiment, the cap 422 is retained by a threaded fastener 432. In an embodiment, threaded fastener 432 is adapted to be coupled to a mounting structure (not shown), such as, for example, a post or pole. The cap 422 is preferably constructed of a thermally conductive material such that the cap 422 is capable of transferring heat from the support structure 442 and cavity 412*a* of the lighting assembly 410 to the mounting structure and external air. The cap 422 is coupled to an end of the support structure 442 and retained thereon with a hollow threaded fastener 432 and a substantially weather-tight gasket 438 disposed between a circumferential lip 440 of fastener 432 and the cap 422. The gasket 438 is preferably constructed of an elastomeric material, such as silicone. In an embodiment, the abutment between the cap 422 and tube 412 substantially protects the internal component 413 of the LED light assembly 410 to an International Protection Rating of 65 ("IP65") to ensure the proper protection from the ingress of external solids and liquids.

At first end 414 of tube 412, a heat dissipation structure 470 is coupled to the support structure 442 and includes a plurality of fins 472 that increase the surface area of heat dissipation structure 470. Heat dissipation structure 470 is coupled to the support structure 442 via a heat sink mounting plate 474 at a proximal end 475 of the heat dissipation structure 470. The heat dissipation structure 470 is coupled to the assembly 410 by a threaded fastener 476 received through a centrally disposed aperture 478 in the mounting plate 474. In an embodiment, a gasket 482, preferably constructed of an elastomeric material, such as silicone, is disposed between the fastener 476 and the mounting plate 474 to provide a weather-tight connection. Fastener 476 includes a downwardly protruding portion 476*a* adapted to penetrate axial cylindrical channel 444 of support structure 442. Fastener 476 is threadably coupled to end 447 of channel 444 via threads 437. Fastener 476 thereby maintains engagement between support structure 442 and mounting plate 474 to thermally couple the support structure 442 and cavity 412*a* to external environment. In an embodiment, fastener 476 is preferably composed of a thermally conductive material, such as, for example, a metal, to provide and enhance external thermal transfer of the heat extracted by the heat dissipation structure enclosed within the tube 412.

In an embodiment, the underside 474*a* of heat sink mounting plate 474 includes a circumferential groove 490. The groove 490 is adapted to have a diameter substantially similar to the diameter of the tube 412 so that the tube 412 end can be inserted therein and friction fitted therewith. In an embodiment, a gasket 492, preferably constructed of an elastomeric material, such as silicone, is disposed within groove 490 to provide a substantially weather-tight interface. The groove 490 is adapted to retain the edge of the open end of the tube 412, wherein the gasket 492 substantially weather-seals the connection between the mounting plate 474 of the heat sink 470 and the tube 412. An integrated heat sink and gasket assembly provides added protection by eliminating possible misalignment between the gasket and the edge of the acrylic tube 412. In an embodiment, the abutment between mounting plate 474 and tube 412 substantially protects the internal component 413 of the LED light assembly 410 to an International Protection Rating of 65 ("IP65") to ensure the proper protection from the ingress of external solids and liquids.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants'contribution. The actual scope of the protection sought is intended to be defined in the following claims when viewed in their proper perspective based on the prior art.

What is claimed is:

1. A light emitting diode (LED) assembly comprising:

a tube including an internal cavity and first and second ends;

a support structure disposed in the internal cavity and having a hollow channel extending axially within the support structure and an external surface facing a surface of the internal cavity, wherein the hollow channel includes first and second internal threads extending continuously around a portion of an inner circumference of the hollow channel respectively proximate the first and second ends;

a heat dissipating structure disposed on the first end;

a first fastener threadingly coupled to the first internal threads to couple the support structure to the heat dissipation structure;

fins extending from the external surface;

a second fastener threadingly coupled to the second internal threads and substantially sealing the internal cavity; and an LED coupled to the support structure and adapted to conduct heat to the support structure.

2. The LED lighting assembly of claim 1, wherein the support structure includes corners, wherein each corner includes at least one of the fins.

3. The LED lighting assembly of claim 1, wherein the support structure has a generally rectangular cross-sectional shape.

4. The LED lighting assembly of claim 1, wherein the support structure has a generally triangular cross-sectional shape.

5. The LED lighting assembly of claim 1, wherein the support structure is constructed of aluminum.

6. The LED lighting assembly of claim 1, wherein the first fastener includes a circumferential lip, and the LED assembly further comprises a first gasket disposed between the circumferential lip and the heat dissipating structure.

7. The LED lighting assembly of claim 1, wherein the heat dissipating structure is a spun cap.

8. An LED assembly comprising:

a tube including a cavity and first and second open ends;

a heat dissipation structure including a finned heat sink coupled to the first open end and substantially sealing the first open end;

a cap coupled to the second open end;

a support structure having first and second support ends and a hollow core extending axially between the first and second support ends, the hollow core including first and second internal threads extending continuously around a portion of an inner circumference of the hollow core respectively proximate the first and second support ends;

a fastener threadingly coupled to the second internal threads to couple the cap to the second support end; and an LED coupled to the support structure and adapted to conduct heat to the support structure, wherein the fastener is hollow and faces atmosphere.

9. The LED light assembly of claim 8, wherein the heat sink includes a circumferential groove having a first gasket disposed therein, and wherein the groove and the first gasket engage the first open end.

* * * * *